US008656526B2

(12) United States Patent
Brewin

(10) Patent No.: US 8,656,526 B2
(45) Date of Patent: Feb. 25, 2014

(54) RECIRCULATING SHOWER SYSTEM

(76) Inventor: Peter Brewin, Cardiff (GB)

( * ) Notice: Subject to any disclaimer, the term of this patent is extended or adjusted under 35 U.S.C. 154(b) by 997 days.

(21) Appl. No.: 11/916,670

(22) PCT Filed: Jun. 7, 2006

(86) PCT No.: PCT/GB2006/002105

§ 371 (c)(1),
(2), (4) Date: Feb. 22, 2008

(87) PCT Pub. No.: WO2006/131743

PCT Pub. Date: Dec. 14, 2006

(65) Prior Publication Data

US 2008/0196156 A1 Aug. 21, 2008

(30) Foreign Application Priority Data

Jun. 7, 2005 (EP) ..... 05253485

(51) Int. Cl.
*A47K 3/28* (2006.01)

(52) U.S. Cl.
USPC ..... 4/597

(58) Field of Classification Search
USPC ..... 4/596–598, DIG. 19
See application file for complete search history.

(56) References Cited

U.S. PATENT DOCUMENTS

| | | | | |
|---|---|---|---|---|
| 4,153,955 | A * | 5/1979 | Hinterberger | 4/493 |
| 4,828,709 | A | 5/1989 | Houser et al. | |
| 4,893,364 | A * | 1/1990 | Keeler | 4/597 |
| 5,208,923 | A * | 5/1993 | Stiver | 4/493 |
| 5,293,654 | A | 3/1994 | Castwall et al. | |
| 5,299,329 | A * | 4/1994 | Constantini | 4/597 |
| 5,438,712 | A * | 8/1995 | Hubenthal | 4/493 |
| 5,620,594 | A | 4/1997 | Smith et al. | |
| 5,623,990 | A * | 4/1997 | Pirkle | 165/298 |
| 6,838,000 | B2 * | 1/2005 | Braun | 4/DIG. 19 |
| 7,018,539 | B2 * | 3/2006 | Mairal et al. | 210/651 |

FOREIGN PATENT DOCUMENTS

DE 4236959 A1 5/1994

* cited by examiner

*Primary Examiner* — Lori Baker
(74) *Attorney, Agent, or Firm* — Brooks Kushman P.C.

(57) ABSTRACT

The present invention provides a recirculating shower system comprising a shower head 22, a circuit configured to recirculate at least part of the used water to the shower head, a heater 18 included in the circuit for heating the recycled water to a temperature at which micro organisms in the water are killed and a heat exchanger 16 arranged to exchange heat between the water flowing towards and away from the heater. The system provides an efficient use of water and energy and also allows a high flow rate of water at a relatively low use of energy and water.

13 Claims, 1 Drawing Sheet

FIGURE 1
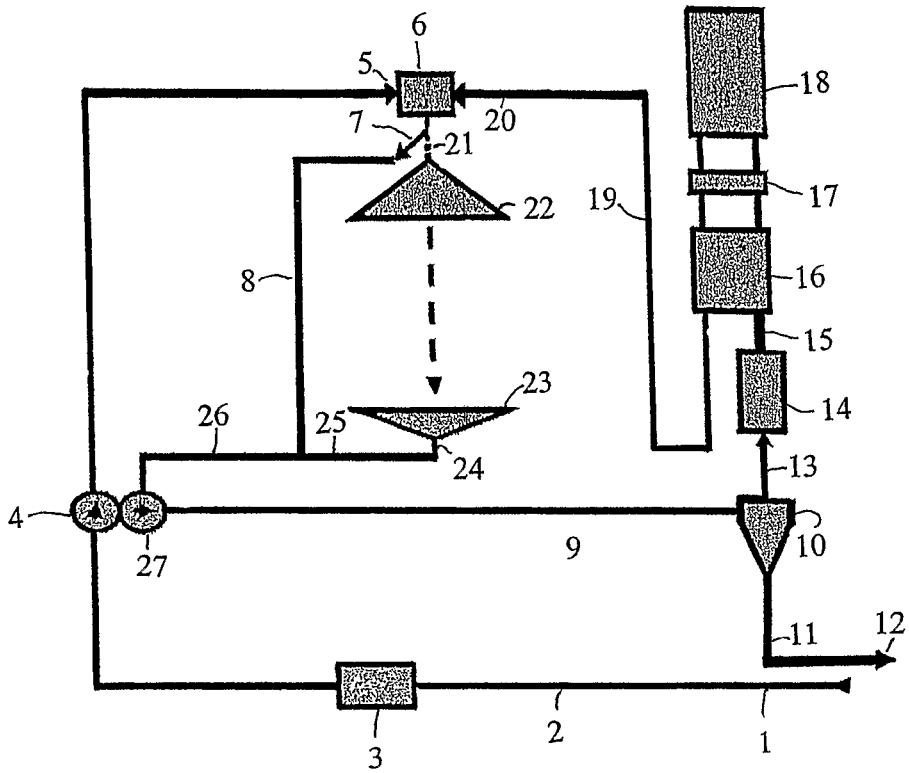
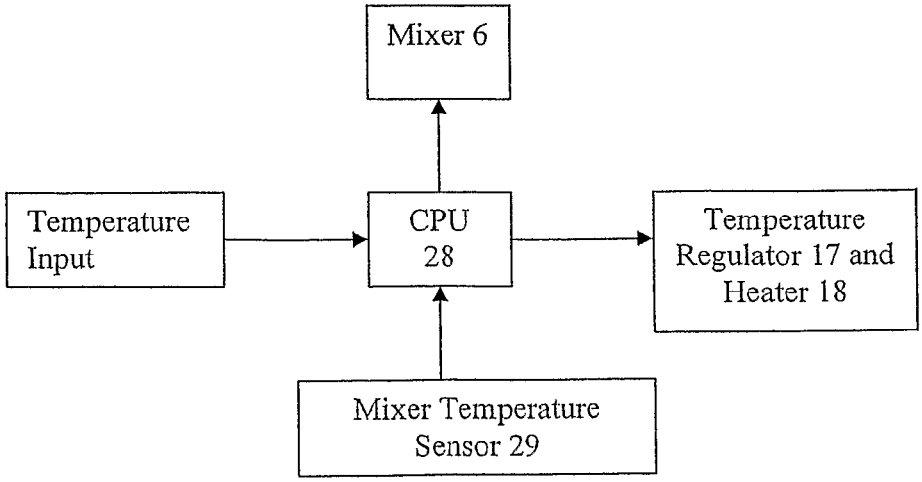
FIGURE 2

RECIRCULATING SHOWER SYSTEM

TECHNICAL FIELD

This invention relates to a water recirculating, cleaning and heating system, which is applicable for example to showers.

BACKGROUND ART

Showers are known that are arranged to recirculate water from the shower outflow back to the shower head, so that the water may be reused, and less water is thereby used. Recirculating showers find application principally in portable and mobile applications such as boats and camping vans. For example U.S. Pat. No. 4,828,709 describes a recirculating shower system for use on boats and recreational vehicles. The recirculating water system, which operates with water from a non-mains water supply in the boat or vehicle, comprises filters, a water heater and fresh and used water storage tanks.

In several parts of the world, fresh water is in short supply and measures are taken to preserve the water supply; for example in Western Australia, tax incentives have been introduced to encourage low water use appliances and the installation of some low water use appliances, such as dual flush toilets, is mandatory.

One problem with the use of recirculating showers in domestic applications lies in regulations that require that any water mixed with mains water must meet water purity standards that the waste water from a shower does not meet. In the United Kingdom, such recirculated water must reach Class 2 standard, as defined by the Water Regulations Advisory Scheme: Fluid Category 1 is defined as "Wholesome water supplied by a water undertaker and complying with the requirements of regulations made under section 67 of the Water Industry Act 1991. Example: Water supplied directly from a water undertaker's main". Fluid Category 2 is defined as "water in fluid category 1 whose aesthetic quality is impaired owing to: (a) a change in its temperature; or (b) the presence of substances or organisms causing a change in its taste, odour or appearance, including water in a hot water distribution system".

Domestic showers commonly in use are of two general types, namely electric showers and mixer showers.

Typically, electric showers draw water solely from a cold mains supply and heat the water as necessary to the desired temperature. This type of shower therefore does not run out of hot water and is able to provide a stable water temperature. They also have the advantage that they are relatively simple to fit in that they require no special plumbing, only a cold water supply.

The maximum power that can be drawn from a standard domestic electricity supply in the UK is 7.5-11.5 kW, which limits the power that is available to heat up the water as it passes through the shower heater. To get a hot enough shower, it may be necessary to limit the flow rate of the water, typically to a maximum rate of 5-6 litres per minute. Obviously, a higher flow rate could be achieved but only at the expense of providing shower water at a lower temperature. In some parts of the world, this problem is made worse since the maximum power that can be drawn is lower than 7 kW, e.g. in some areas of China, the maximum power that can be drawn is 3 kW, which ultimately can make electric showers unusable due to the extremely low flow rate of heated water.

Electric showers are currently the most common type of domestic shower in the UK market.

Mixer showers achieve the desired water temperature by blending water taken from both hot and cold water supplies using a valve. Mixer showers require both hot and cold water supplies and so obviously require a source of hot water, e.g. a hot water tank or a combination boiler or a multipoint water heater. They therefore require more complicated plumbing than electric showers. In addition, if the water supply is not constant, e.g. because someone else is drawing hot water, the temperature of the shower can fluctuate. However, mixer showers can achieve a higher flow rate than electric showers and are cheaper than electric showers.

Power showers are a variant of mixer showers and include a pump.

Hydrocyclones are known and are mainly used in industrial applications such as in mining (for separating slurries into solids and water), in the field of oil and gas (for the separation of gas from oil/seawater and the separation of oil from seawater) and the paper making industry (for separating out pigments in paper manufacturing). A domestic use of an air cyclone can be seen in Dyson™ vacuum cleaners, which separate dust particles from air. The use of hydrocyclones is also known in central heating systems to remove air bubbles. Hydrocyclones have not previously been applied to shower systems.

DISCLOSURE OF THE INVENTION

The invention is set out in the claims. In general terms, it provides a recirculating shower system comprising a shower head, a circuit configured to recirculate at least part of the used water to the shower head, the circuit including a heater for heating the recycled water, and a heat exchanger arranged to exchange heat between the water flowing towards the heater and water flowing away from the heater.

In the present invention, at least a proportion of the water used in a shower is recycled during the showering process. The recycled water is heat treated in the heater to kill or attenuate biological material, e.g. bacteria, in the recycled water. A heat exchanger is provided to heat up the water provided to the heater, thereby reducing the heating load on the heater, and to cool the water returned to the showerhead to a temperature that, when mixed with fresh water, is suitable for showering.

In accordance with the present invention, recycled water can be treated to a standard at which it is acceptable for connection to a mains supply. Further cleaning of the recycled water can be achieved by means of a hydrocyclone and/or a filtration system.

Preferably, recycled water is first passed to a hydrocyclone, which is of generally hollow inverted cone shape; water is injected tangentially into the interior of the cone near the top and forms one or more vortices. Two outlets are provided: one outlet for discharging the waste water containing the concentrated particles, situated at the tapered base of the separating chamber (underflow) and one for the 'clean' water, located at the top of the chamber (overflow). The vortices in the hydrocyclone cause the heavier (dirty) liquid and particles to move towards the outer wall of the chamber due to centrifugal force and the lighter (cleaner) liquid moves towards the centre of the conical chamber. A first outer vortex carries the heavier liquid out of the chamber through the underflow. A second inner vortex carries the lighter liquid in the centre of the chamber upwards through the overflow outlet. The present invention lies partly in the realisation that a more efficient cleaning of water can be achieved by use of a hydrocyclone to separate a clean and a soiled part and the clean part can be recycled. two liquid phases.

The filter may be any filter that can separate soap and fine solids from water and is preferably an activated carbon filter.

This filter preferably also removes harmful chemicals, including chlorine. Showering in chlorine-containing water can lead to absorption of chlorine through the skin and the inhalation of chlorine vapours. Removing chlorine from the water is beneficial to health and results in softer hair and healthier skin. In order to ensure effectiveness, such filters need to be replaced at regular intervals. The inclusion of a hydrocyclone, positioned upstream of the filter in the present system, leads to these filters needing to be replaced less frequently.

The hydrocyclone and filter system restore the optical clarity of the water and remove some harmful chemicals and contaminants. The heating of the recycled water ensures that at least an acceptable proportion of the micro organisms present in the water are rendered harmless. This could be compared to a process of pasteurisation.

The amount of water being recycled can be set by controlling the size of the outlets of the hydrocyclone. 50-95% of the water dispensed through the shower head may be recycled. If too little is recycled, the advantages of the present invention are minimised; on the other hand, if the proportion of water recycled is too high, it is difficult to clean the recycled water. Preferably, the proportion recycled is 60 to 80%, e.g. about 70%.

The shower may incorporate a valve that can be switched between a position in which it is arranged to supply water to the shower head and a position in which it is arranged to divert water upstream of the shower head into the recycle circuit. The presence of the bypass valve avoids cold water being discharged from the shower head at the start of a shower. It also provides the possibility of incorporating a 'pause' function, whereby the water is temporarily prevented from flowing through the shower head during the showering process. Instead, the water continues to be pumped through the recirculating system via a bypass valve. In this way, when the showering process is reinstated, the correct temperature water will emerge from the shower head.

The recirculating shower system of the present invention provides several advantages over the types of showers currently in use.

- At least a proportion of the used shower water is cleaned and reused, resulting in a significant conservation of water. About 70% less water is consumed by the shower system of the present invention compared to a standard non-recirculating shower system. The amount of water saved will vary from shower to shower but will typically be about 24 liters per showering session. This calculation is based on a shower in the UK at 40° C. using 42 litres of water, with a maximum system capacity of 5 litres.
- Energy is saved partly due to the heat in the recycled water and partly due to the efficient arrangement of the heater and the heat exchanger in the recirculation circuit, which allows for the use of high temperatures to heat treat the recycled water while using the heat energy to achieve the desired showering temperature. This energy saving corresponds to approximately 2 MJ per shower, or 40% less energy than is consumed using a standard electric shower (based on a shower in the UK at 40° C. using 42 litres of water, with a maximum system capacity of 5 litres).
- The recirculating shower of the present invention can achieve a greater water flow rate than electric showers can currently reach with a domestic electricity supply. A flow rate of 8 liters per minute with a 6 kW power supply can be achieved. This is due to the heat recovery from the recycled water.
- The system of the present invention has the same simplicity of installation as an electric shower, namely only a cold water mains supply and an electrical supply are required, while being able to provide shower flow rates comparable to those of mixer showers. Installation of this shower system would therefore be simple, as there would be no need to install a new boiler or any other reason necessitating expensive plumbing services, which may be the case with mixer types of shower systems.
- The inflow of an amount, e.g. about 30%, fresh water into the recirculating system allows precise temperature control and the removal of the same amount, i.e. about 30%, of the used water carries away a greater proportion of the contaminants in the used water.
- The shower cannot run cold regardless of how many people use the shower, since it does not use a separate source of hot water and the water is heated as and when necessary. This is not the case with standard mixer showers, which draw warm water from a storage means.
- The use of the heat exchanger allows the recycled water flowing into the heater to be heated and so the additional energy provided by the heater can heat the water to the required heat treatment temperature using the limited power input of an electricity supply. Without the heat exchanger, it would be hard for the heater to achieve such temperatures.

Preferably a Central Processing Unit (CPU) is included in the system to control the operation of the various valves, the water heater and the pump. A control, which may take the appearance of a conventional shower tap or a digital display unit, could send signals to the CPU, which in turn would control the temperature of the heater and the amount of water flowing through it to ensure the required heat treatment takes place and also controls the temperature of water being fed to the showerhead by controlling the amount of fresh water that is mixed with the recycled water. Temperature and flow sensors could be provided at appropriate places within the recycle circuit to provide the data necessary to achieve this control.

BRIEF DESCRIPTION OF THE DRAWINGS

A specific embodiment of the invention will now be described by way of example with reference to the accompanying drawings:

FIG. 1 is a schematic view showing the invention viewed in the vertical plane;

FIG. 2 is a schematic view of the interaction pathways between the Central Processing Unit and the elements of the system that it controls.

DETAILED DESCRIPTION AND BEST MODE FOR CARRYING OUT THE INVENTION

The shower system shown in FIG. 1 includes a showerhead 22, which is connected to a mains cold water inflow 1 via a water pipe 2, a hydraulic jump 3 and the inlet 5 of a mixer 6. In a preferred embodiment, a pump 4 is located between the hydraulic jump and the mixer to pump the water to the showerhead. The mixer may for example be an Aqualisa digital Quartz system, such as the Aqualisa Quartz A1, which uses a single stepper motor with a profiled disk mounted on it. The control electronics could be integrated onto the same Printed Circuit Board as the shower controls. The interface could for example be manufactured in high volumes and at low cost, by printing the connections onto acetate, using the same methods used to produce computer keyboards.

Water dispensed through the showerhead is collected in a basin 23 located below the showerhead, forming the floor of the shower cubicle, and allowed to run down a drain 24 into water pipes 25, 26 and is pumped by a pump 27 towards a hydrocyclone 10.

The pumps 4 and 27 may be separate but are preferably combined into a single double-headed pump, which pumps both the water in the recirculating system as well as the water from the cold mains supply. Such a pump could for example be an Aqualisa Type 3TE, 230V, 3 Bar double headed booster pump.

The inclusion of a pump 4 on the cold mains supply between the hydraulic jump 3 and the mixer 6 is preferable, as this enables better control of the proportion of fresh cold water being added into the system. The inclusion of a pump is however not an essential feature of the present invention.

The hydrocyclone 10, whose operation is described above, separates out solid materials and materials that are denser than water. A water stream with the dense materials flows through an outlet 11 (the underflow) at the bottom of the hydrocyclone and carries it to a waste water pipe 12; the clean water is recycled and directed back into the system, leaving the hydrocyclone via outlet 13 (the overflow) in the top of the hydrocyclone. The hydrocyclone can, as is known, be tuned to separate a desired proportion of the underflow and the overflow by adjusting the diameters of the outlets for the two separated streams. The hydrocyclone may for example be a single piece of blow moulding. In the preferred case, about 30% of the water flowing into the hydrocyclone is separated out from the recirculating system and this carries with it the solids and heavier particles. The proportion of water being recycled is in the range of 50-95%, preferable 60-80%, more preferably 65-75% and most preferably about 70%. The clean water exiting the hydrocyclone through the overflow outlet is directed towards and through a carbon filter 14 or a sequence of filters.

The hydrocyclone is situated upstream of the filter so that it removes the bulk of the contaminants from the water before the water is filtered and so that the filter only has to cope with the smaller volume of the separated clean water.

The filter 14 may be a standard water filter, for example an 'Aquasana' 2-stage Filter, which reduces or removes unwanted contaminants such as chlorine, synthetic-, and volatile organic chemicals and heavy metals from the water. A suitable filter system could for example comprise activated charcoal (e.g. coconut shell carbon, bituminous carbon) or it could be a KDF filter (a copper-zinc alloy mineral media). A KDF filter removes chlorine, heavy metals and micro organisms from water.

The water filter 14 is preferably replaceable, and it is typically recommended that filters are changed every 4-6 months. Other types of filters may further be included in addition or as an alternative to the filter described above, to further reduce the contaminants and optimise the water quality.

Once the water has passed through the filter 14, it is directed into one limb of a heat exchanger 16 and from there, via a transfer flow regulator 17, into a heater 18. After having flowed through the heater, the water flows back through a second limb of the heat exchanger 16. Water flowing through the first limb of the heat exchanger, that is to say in the direction from the filter 14 towards the heater 18, is heated by water flowing in the second limb of the heat exchanger, that is to say the water that has already passed through the heater 18. The water flowing in the second limb is cooled down by this process. A plate heat exchanger can be manufactured at relatively low cost from pressed stainless sheet steel and may for example be an ANC B 219984 2 1c Plate Type Heat Exchanger.

In the heater 18, the water is heated to a temperature, for example 60-95° C., e.g. 80-90° C., and is retained within the heater for a sufficient dwell time for microorganisms, for example bacteria such as *Legionella*, in the water to be killed or attenuated. In order to achieve this "pasteurisation" of the water, the length of the water pipe within the heater is sufficiently long as to provide the required dwell time, which may be 30 seconds. The heater may be a standard 6 kW heater element as used in conventional showers, for example a 6 kW heater from an Aquastyle electric shower unit, produced by Aqualisa.

The solid state temperature/flow regulator 17 controls the flow of water into and out of the heater to provide that the water in the heater is exposed to the required temperature for the required dwell time, preferably without the flow of water being interrupted, paused or slowed. The solid state temperature regulator valve has a heat capacity range of 72-95° C. If it restricts the flow of water, e.g. to increase the dwell time in the heater or because the water in the heater has not reached the required temperature, water may back up to the hydrocyclone 10 and a higher proportion of water will leave the system via the waste water outlet 11. The solid state temperature regulator consists of 2 bimetallic domes, which are a standard low cost component used in all electric showers and can be purchased to cover most temperature ranges. Alternatively, the regulator could for example be a component fitted to the Aqualisa, Aquastyle electric shower unit.

Unlike an electric shower, the heat exchanger in the present invention ensures that the energy used to heat the water is recovered and used to maximum efficiency. In an electric shower, the energy used to heat the water is used inefficiently as the water is heated and then allowed to drain away.

By positioning the hydrocyclone upstream of the heater, only the water that will actually be used again will be heated. Therefore no energy is wasted in heating up the proportion of water that is discharged from the system. Moreover, it is also only the water that will be reused that will pass though the filtration system. The filters will hence not be clogged up and exhausted unnecessarily.

Once the water has passed through the heater 18 and the heat exchanger 16, it continues to flow towards the mixer 6 via a pipe 19 and enters the mixer 6 through an inlet 20. Cold water is drawn from the cold mains supply and blended with the hot water. If the temperature of the 'blended' water, as measured by a temperature sensor 29 (see FIG. 2 and description below) is above or below the desired temperature, the mixer alters the proportion of the fresh cold water so that the water is at the desired temperature.

FIG. 2 shows the interaction pathways between the Central Processing Unit (CPU) 28 and other elements of the recirculating system. The CPU receives data from the temperature sensor 29 in the mixer 6 and any other temperature sensors provided in the system. By processing this data, the CPU controls the activity of the mixer 6, the heater 18, the temperature regulator 17, the pumps 4 and 27 and a bypass valve 7 (see below).

A temperature input control, which may take the appearance of a conventional shower tap or a digital display unit, sends control signals to the CPU, for example setting the shower temperature and controlling the start and stop operation; the CPU also receives signals from the various temperature sensors.

The CPU controls the temperature of the heater and the amount of water flowing through it by means of the temperature/flow regulator 17, both to ensure the required heat treatment takes place and also to set the temperature of the heater 18 to control the temperature of the shower with the optimum use of water and heating energy. The CPU also controls the mixer 6 to set the amount of fresh water that is mixed with the recycled water to achieve the desired shower water temperature. Temperature and flow sensors are provided at appropriate places within the recycle circuit to provide the data necessary to achieve this control.

On start-up, a temperature sensor 29 in the mixer measures the temperature of the 'blended' water fed to the showerhead. If has not yet reached the desired water temperature, a bypass valve 7 diverts the water away from the shower head, to pipe 26 to return it to the used water circuit. This cycle is continued until the set temperature, as measured by the sensor 29, is reached, at which point the bypass valve 7 is closed and the water will flow through the shower head 22 via a pipe or hose 21. The reaching of the desired water temperature may optionally be indicated to the user, for example by means of a flashing light on a display panel and the user could then close the bypass valve 7 causing the water to flow through the shower head 22. The bypass valve could for example be a standard servo controlled valve, such as for example the Bonsai Servo Controlled Valve. The display panel, for example the Maplin N63AX Full Colour LED, and the power supply for the electroluminescence could be mounted on the same Printed Circuit Board as the control electronics.

There are two alternative possible methods of regulating the water temperature of the shower, which are essentially as follows: Either the temperature to which the heater heats the water may be altered, subject to the minimum temperature required to destroy any bacteria present in the water; or the proportion of cold water drawn from the cold water mains and blended with the recycled water may be altered.

The maximum drop in the water temperature across a 2.2 meter drop from the shower head to the basin has experimentally been found to be about 4° C. As an example, the water in a warm 39° C. shower, flowing from the drain towards the hydrocyclone could therefore be around 35° C. As it flow through the heat exchanger, the temperature of this water will be increased by the water flowing from the heater towards the heat exchanger. The heater heats the water to approximately 80-90° C. and the water leaving the heat exchanger toward the heater will increase in temperature from approximately 35° C. to approximately 65-75° C. Concurrently, on contact with the water flowing towards the heater, via the heat exchanger, the temperature of the water flowing away from the heater will be reduced from 80-90° C. to about 50-60° C. The heat exchanger therefore promotes efficiency, by using the heat created by the heater to pre-warm the water flowing towards the heater, so that the heater needs to use less energy in order to heat up the incoming water, and also to use the cooler water flowing towards the heater to cool down the water flowing away from the heater and towards the shower head. This means that a desired shower water temperature of about 40° C. can be achieved without having to draw a huge amount of water from the cold mains supply. The inflow from the cold mains supply can thereby easily be kept to about 30% of the total recirculating water.

If the water is desired to be cooler, then the heater can be adjusted to heat the water only to the minimum temperature to render any bacteria in the water harmless. This minimum temperature could for example be set at around 65° C. Instead or in addition, the amount of freshwater that is added to the system in mixer 6 could be increased. If warmer water is required, then the temperature of the heater could be increased, for example to around 90° C. and/or the amount of water added by the mixer could be decreased. In practice short timescale fluctuations in the water temperature are controlled by adjusting the amount of fresh water added in the mixer 6 while longer-timescale variations can be achieved by altering the heater temperature.

At the end of the shower, the water is switched off by the user. This causes the bypass valve 7 to be opened and the heater and the pump to be switched off. No further cold water is drawn into the system. The water remaining in the system will drain out under gravity, and will drain from the system via the bypass valve 7 (rather than through the shower head 22), and pass through the hydrocyclone to the waste water outlet 12. An air inlet or vent is located at the bypass valve 7 to assist in the draining of the recycled water from the system.

A 'pause' function could be incorporated into the system by providing a switch that, when activated, sends a signal to the bypass valve 7 causing it to open. The water would then be diverted from the shower head and instead be pumped through the recirculating loop via the bypass valve. When it is desired to resume showering, the bypass valve 7 is closed.

A collecting basin 23, such as the one shown in FIG. 1, could alternatively be a slanted floor that slopes towards a drain 24.

A further heat exchanger may optionally be incorporated to transfer heat energy from the waste water in pipe 11 to the water from the mains cold water supply.

Because of the ability to recover considerable heat energy from the heated water by means of a heat exchanger 16, substantial energy savings are made. Additionally, this efficient water heating arrangement makes it possible to achieve a high water flow rate comparable to that found in power showers. This is far greater than could be achieved with a standard electric shower and domestic electricity supply.

The invention claimed is:

1. A recirculating shower system that comprises:

a shower head; and a circuit configured to recirculate water that has been dispensed from the shower head without storing the water, the circuit including:

a hydrocyclone separator for separating the water that has been dispensed from the shower head, the hydrocyclone separator being configured to separate the water into a waste water portion that is heavier, and a clean portion that is lighter, and return the clean portion directly back into the circuit for recirculation to the shower head and direct the waste water portion to a waste water pipe.

2. A recirculating shower system as claimed in claim 1, comprising a filter for filtering the recycled water.

3. A recirculating shower system as claimed in claim 2, the circuit further comprising a heater configured to heat the recirculated water to a temperature at which biological material in the recirculated water is killed or attenuated prior to returning it to the shower head; and a heat exchanger arranged to exchange heat between the relatively hot water leaving the heater and the relatively cool water flowing to the heater.

4. A recirculating shower system as claimed in claim 3, wherein the separator is arranged upstream of the filter.

5. A recirculating shower system as claimed in claim 3, comprising an inlet configured to receive fresh water from a water pipe and a mixer arranged upstream of the shower head and downstream of the heater for mixing fresh water with recycled water.

6. A recirculating shower system as claimed in claim 3, wherein the heater heats the water to a temperature sufficient to pasteurize the water.

7. A recirculating shower system as claimed in claim 3, further comprising a temperature regulator that is capable of controlling the heater so that it heats the recycled water to a desired temperature range.

8. A recirculating shower system as claimed in claim 3, further comprising a valve that can be switched between a position in which it is configured to supply water to the shower head and a position in which it is arranged to divert water from upstream of the shower head and downstream of the heater to upstream of the heater.

9. A recirculating shower system as claimed in claim 1, wherein 60 to 80 percent of the water that has been dispensed from the shower head is recirculated and 20 to 40 percent is directed to a waste water pipe.

10. A recirculating shower system as claimed in claim 3, wherein the circuit is configured such that the recirculated water flows directly from the heater to the heat exchanger.

11. A recirculating shower system that comprises:

a shower head;

a circuit configured to recirculate water that has been dispensed from the shower head without storing the water, the circuit including:

a hydrocyclone separator for separating the water that has been dispensed from the shower head, the hydrocyclone separator being configured to separate the water into a waste water portion that is heavier, and a clean portion that is lighter, and return the clean portion directly back into the circuit for recirculation to the shower head and direct the waste water portion to a waste water pipe;

a heater configured to heat the recirculated water to a temperature at which biological material in the recirculated water is killed or attenuated prior to leaving the heater and returning it to the shower head; and a heat exchanger arranged to exchange heat between the relatively hot water leaving the heater and the relatively cool water flowing to the heater.

12. A recirculating shower system as claimed in claim 5, wherein the mixer is configured to mix 20 to 40 percent fresh water with 60 to 80 percent recycled water.

13. A recirculating shower system as claimed in claim 3, wherein the filter is arranged upstream of the heater.

* * * * *